US005630764A

United States Patent [19]

McNair

[11] Patent Number: 5,630,764

[45] Date of Patent: May 20, 1997

[54] ILLUMINATED GOLF CLUB HEAD

[76] Inventor: Rhett McNair, 238 Harris Lake Dr., Lake City, Fla. 32055

[21] Appl. No.: 611,166

[22] Filed: Mar. 5, 1996

[51] Int. Cl.[6] ..... A63B 69/36

[52] U.S. Cl. ..... 473/220; 473/268

[58] Field of Search ..... 437/220, 223, 437/268, 211

[56] References Cited

U.S. PATENT DOCUMENTS

| | | | |
|---|---|---|---|
| 2,158,211 | 5/1939 | Aitken . | |
| 2,787,470 | 4/1957 | Barrus et al. . | |
| 3,182,508 | 5/1965 | Varju | 473/223 |
| 3,191,939 | 6/1965 | Hooper . | |
| 3,362,023 | 1/1968 | McMahon | 473/211 X |
| 3,380,305 | 4/1968 | Charell | 473/224 X |
| 3,436,076 | 4/1969 | Barthol . | |
| 3,992,011 | 11/1976 | Jessee | 473/268 |
| 4,930,787 | 6/1990 | Nobles, Jr. . | |
| 5,080,362 | 1/1992 | Lillard | 473/220 X |
| 5,401,030 | 3/1995 | Halliburton . | |
| 5,470,072 | 11/1995 | Cunningham | 473/220 |

FOREIGN PATENT DOCUMENTS

| | | |
|---|---|---|
| 653471 | 12/1962 | Canada . |
| 6165845 | 6/1994 | Japan . |
| 1270422 | 4/1972 | United Kingdom . |
| 2039749 | 8/1980 | United Kingdom . |
| 2110095 | 6/1983 | United Kingdom . |

*Primary Examiner*—George J. Marlo

*Attorney, Agent, or Firm*—Saliwanchik, Lloyd & Saliwanchik

[57] ABSTRACT

An illuminated golf club head defines a cavity and includes a top surface and a face for impacting a golf ball during a swing. A light is mounted at the top surface, and a power source for energizing the light is disposed within the cavity and electrically connected to the light. A switch is mounted within the cavity and electrically connected to the light and battery to form an electrical circuit. In an embodiment, the switch closes, completing the circuit and momentarily illuminating the light, upon impact of the face with a golf ball. In another embodiment, the switch closes to momentarily illuminate the light upon impact of a golf ball at approximately the center of the face.

17 Claims, 3 Drawing Sheets

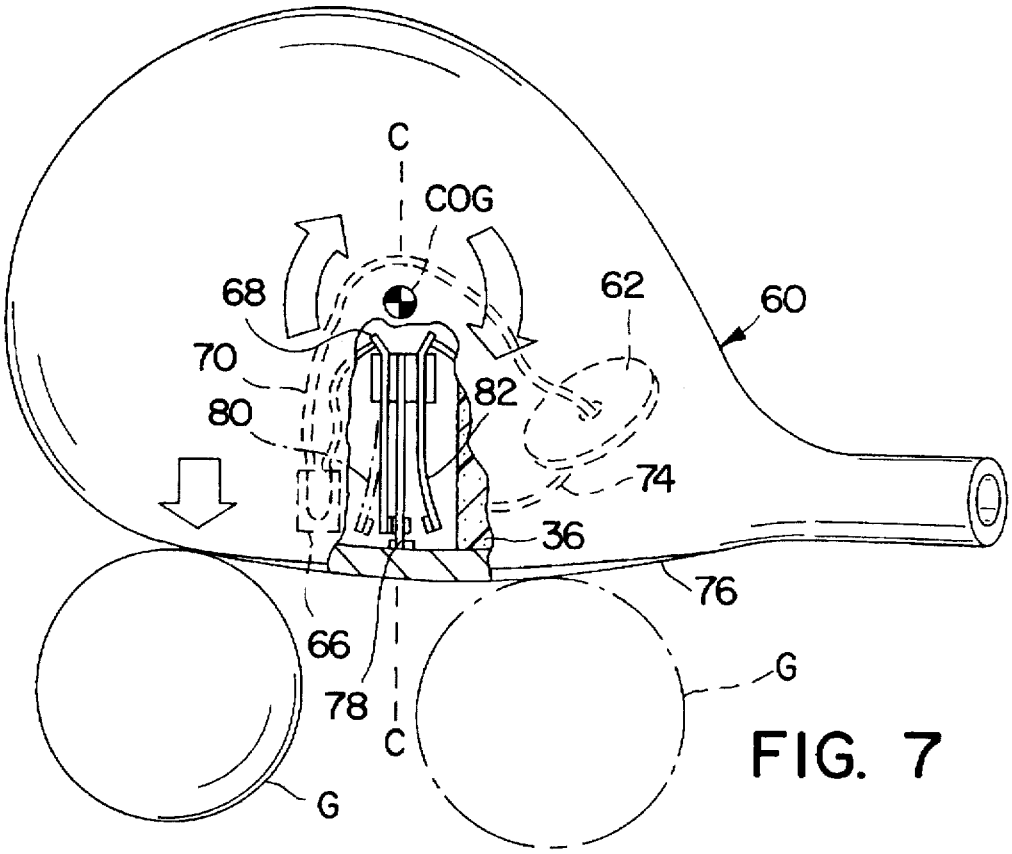
FIG. 7
FIG. 8
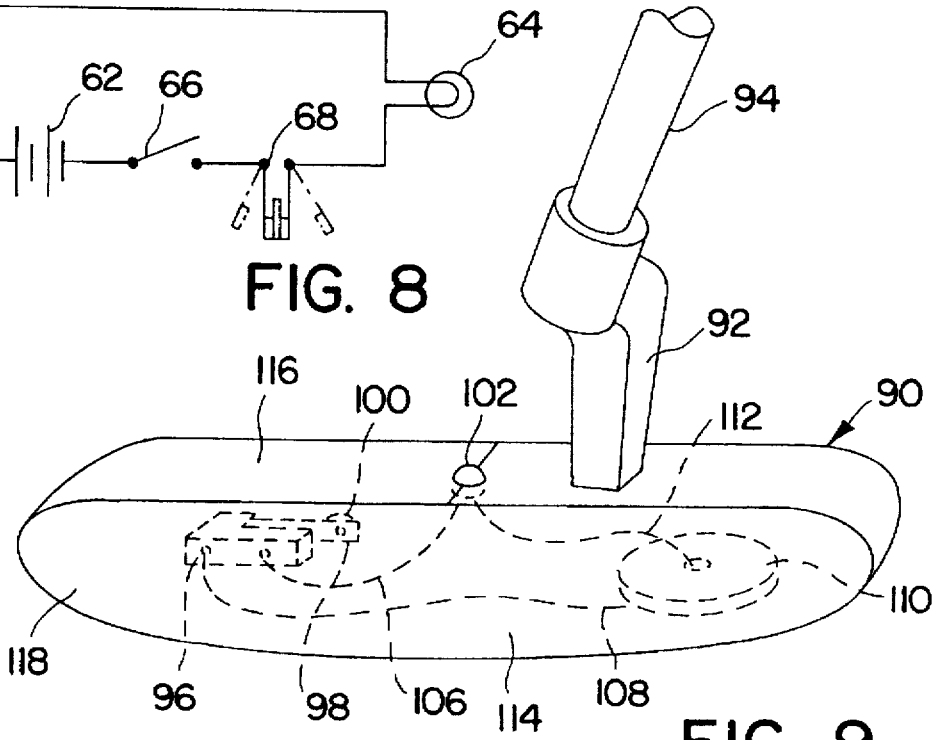
FIG. 9

ILLUMINATED GOLF CLUB HEAD

BACKGROUND OF THE INVENTION

1. Field of the Invention

The invention relates generally to the field of golf and, more particularly, to an illuminated golf club head.

2. Discussion of the Related Art

One of the most important factors in executing a proper golf swing is keeping the eyes focused on the ball during the entire swing, and particularly during the forward stroke. Golfers have a natural tendency to raise their head Just prior to the moment of contact between the club head and the ball and watch the ball's flight. This tendency is so strong that golfers may do it unknowingly and actually believe that their eyes are fixed on the ball throughout the entire swing.

Failing to focus on the ball during the entire swing detrimentally affects the ball's travel. Most importantly, the club head does not consistently contact the ball at the "sweet spot", located approximately at the center of the face of the head, and, consequently, the ball does not travel with the desired velocity and accuracy.

A number of devices have been developed for use in golf clubs to allow golfers to monitor different aspects of their swings. Devices that sense club speed or momentum during a swing are disclosed in U.S. Pat. Nos. 2,158,211 to Aitken and 5,401,030 to Haliburton, and Canadian Pat. No. 653, 471.

Devices that include lights to enable golfers to follow the path of the club during a swing are disclosed in U.S. Pat. No. 2,787,470 to Barrus et al. and British Pat. Nos. 1,270,422; 2,039,749 and 2,110,095.

U.S. Pat. No. 4,930,787 to Nobles, Jr. discloses a putter including a signaling device which is illuminated when the putter is non-parallel to the horizon or is rotated during the backstroke.

U.S. Pat. No. 3,191,939 to Hooper discloses a swing indicator for detecting inside-out and outside-in swings.

Japanese 6-165845 discloses a golf club including a light source and a sensor to sense the centrifugal force created during a swing or the impact force of the club with a golf ball.

The known devices for golf clubs are inadequate, however, for important reasons. The known devices do not visually aid golfers in watching the ball through the entire stroke and, consequently, in forming the habit of doing so. The known devices also do not provide a positive visual signal to golfers that the club head is consistently contacting the golf ball at the desired location. Furthermore, the known devices are generally heavy and bulky, and may alter the balance of the associated golf club. Consequently, the known devices may actually have the adverse effect of increasing the difficulty of performing a proper swing. In addition, some of the known devices are mounted to the exterior of the shaft or club head and make the associated golf clubs aesthetically unattractive.

SUMMARY OF THE INVENTION

The present invention has been made in view of the above-described deficiencies of the known devices and has as an object to provide an illuminated golf club head which trains golfers to focus on the golf ball during the entire swing.

Another object of the present invention is to provide an illuminated golf club head which trains golfers to consistently contact the ball at the desired location on the club head.

Still another object of the present invention is to provide an illuminated golf club head which can be installed on different types of clubs, including metal drivers, putters and irons.

Yet another object of the present invention is to provide an illuminated golf club head having a simple construction and providing long-term reliable operation.

A further object of the present invention is to provide an illuminated golf club head having the feel of a conventional head and an aesthetically attractive appearance.

Additional objects and advantages of the present invention will become apparent from the detailed description which follows and the accompanying drawings. To achieve the objects of the invention, the illuminated golf club head in accordance with a preferred embodiment of the invention comprises an outer wall which defines an interior cavity. The outer wall includes a top surface, and a face for impacting a golf ball during a swing. A light is mounted to the outer wall, preferably at the top face and directly in the line of sight of the golfer at the point of impact with a golf ball during a swing. A battery and a switch provided within the cavity are electrically connected to the light to form a circuit. The switch closes to complete the circuit and momentarily illuminate the light upon impact of the face with the golf ball.

The golf club head in accordance with another preferred embodiment of the invention comprises switch means adapted to close to complete the circuit and momentarily illuminate the light only upon impact of a golf ball at approximately the center of the face.

BRIEF DESCRIPTION OF THE DRAWINGS

In the accompanying drawings:

FIG. 7 is a top illustrational view of the illuminated golf club head of FIG. 5 depicting the open condition of the leaf switch upon impact of the golf ball at opposite sides of the line C—C;

FIG. 8 is a schematic diagram of the electrical circuit of the illuminated golf club head of FIG. 5; and FIG. 9 is a front perspective view, partially in broken line, of an illuminated golf club head in accordance with another embodiment of the invention.

DETAILED DESCRIPTION OF THE PREFERRED EMBODIMENTS

Figure 1:
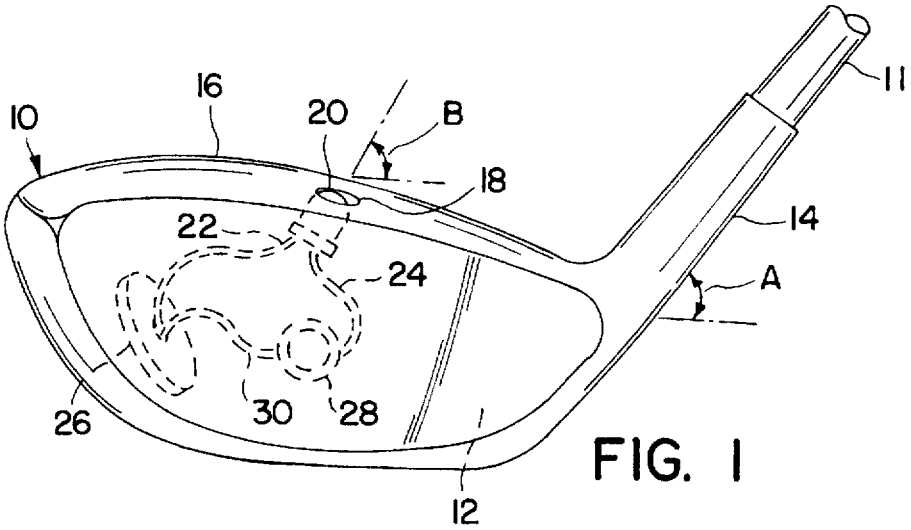
FIG. 1 is a front perspective view, partially in broken line, of an illuminated golf club head in accordance with an embodiment of the invention.

The preferred embodiments of the invention will now be described in detail with reference to the drawing figures.

FIGS. 1–4 illustrate a preferred embodiment of the illuminated golf club head 10 in accordance with the invention attached to a shaft 11. The illustrated head is known as a metal driver or a metal wood. The invention may optionally be used in other types of clubs such as putters (FIG. 9) and irons. The head 10 has a hollow construction defining an internal cavity 12. The neck 14 of the club head is oriented at an angle, A, relative to the horizontal.

The top face 16 of the club head 10 defines an opening 18 in which a light 20 is mounted. The light is preferably a light emitting diode (LED) capable of emitting a high intensity light readily visible to golfers even during bright light conditions. The LED 20 is oriented at an angle, B, so that the light is in the direct line of sight of the golfer at the point of impact between the head and a golf ball during the forward stroke of a swing.

The LED 20 includes a pair of electrical conductors 22, 24. The conductor 22 is connected to a battery 26 which energizes the LED. The battery is preferably small and disc-shaped. For example, a 3-volt lithium-type battery provides a suitable long service life and requires only infrequent replacement. The other electrical conductor 24 is connected to a switch 28 electrically connected to the battery 26 via an electrical conductor 30 to form an electrical circuit.

Figure 2:
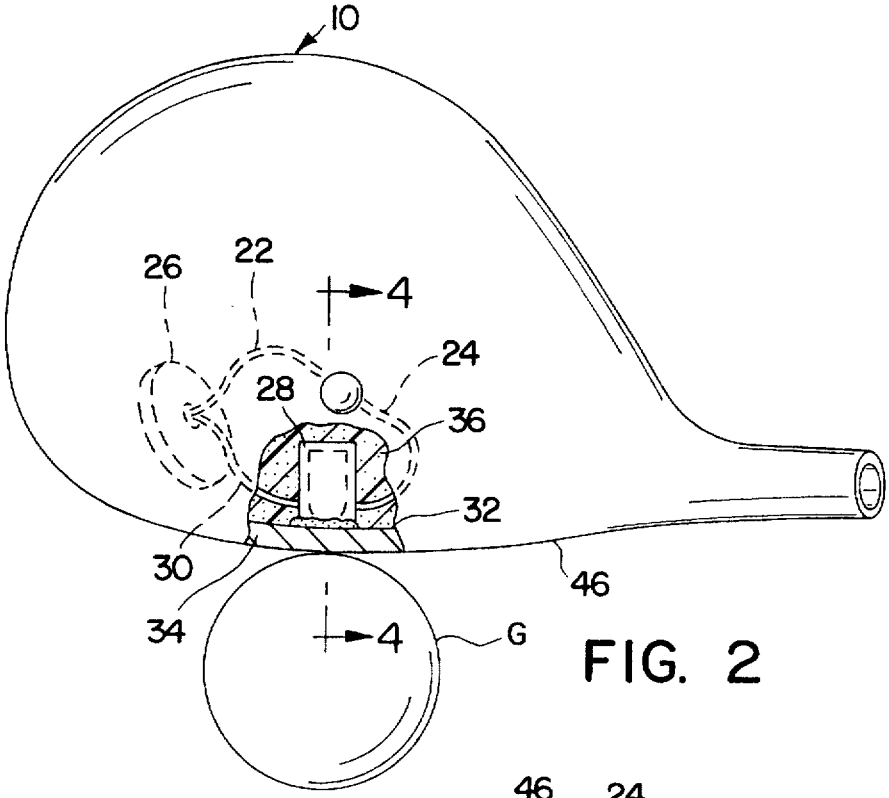
FIG. 2 is a partially broken away, top illustrational view of the illuminated golf club head of FIG. 1 showing the location of the impact switch and impact with a golf ball.

Referring to FIG. 2, the impact switch 28 is secured to the inner surface 32 of the outer wall 34 of the head 10, approximately at the center of the outer wall, preferably using silicone rubber or a like adhesive. The cavity of the head is preferably filled with a lightweight foam material 36 to fix the circuit components and give the metal driver the sound and feel of a wood driver.

Figure 3:
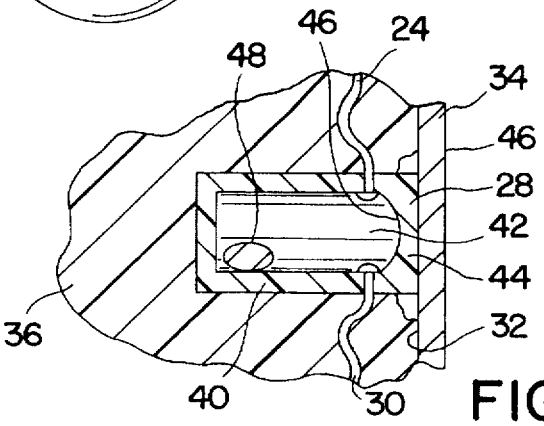
FIG. 3 is an enlarged cross-sectional view of the impact switch taken in the direction of line 4—4 of FIG. 2 before impact with the golf ball.
Figure 4:
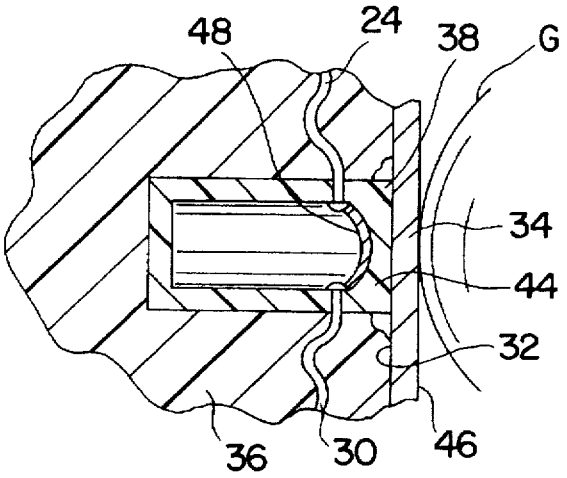
FIG. 4 is an enlarged cross-sectional view of the impact switch taken in the direction of line 4—4 of FIG. 2 upon impact with the golf ball.

Referring to FIGS. 3 and 4, the impact switch 28 is preferably a mercury impact switch. As shown, the mercury switch 28 comprises a tubular body 40 which defines a chamber 42. The body includes an end wall 44 having an interior concave region 46. The end wall 44 is mounted to the inner surface 32 of the outer wall 34. Referring to FIG. 3, the electrical conductors 24 and 30 are connected to the impact switch 28 and extend into the chamber 42 adjacent the end wall 44. A volume of mercury 48 is freely movable within the chamber. The mercury naturally forms a droplet smaller than the distance between the electrical conductors 24 and 30 so that the electrical circuit is normally open and the LED 20 is non-activated.

The impact switch 28 closes and, consequently, causes the LED 20 to momentarily emit light, when the golf ball G impacts the face 46 of the head 10 during the forward stroke of a swing. Referring to FIG. 4, this impact causes the mercury 48 to sharply collide against the concave region 46 of the end wall 44 and flatten sufficiently that it simultaneously touches both electrical conductors 24 and 30, closing the electrical circuit and causing the LED 20 to momentarily illuminate. The impact may be at substantially any location on the face 46. The emitted light is visible to the golfer only if eye contact is maintained with the ball throughout the swing.

Another preferred embodiment of the invention is illustrated in FIGS. 5–8. The golf club head 60 comprises a battery 62, an LED 64 and a pair of switches 66, 68. The first switch 66 is an impact switch electrically connected to the battery 62 via an electrical conductor 70 and to the second switch 68 via an electrical conductor 72. The LED 64 is electrically connected to the second switch 68 via an electrical conductor 73 and to the battery via an electrical conductor 74. FIG. 8 is a schematic diagram of the electrical circuit of the illuminated golf club head 60.

The impact switch 66 is preferably of the same type as the impact switch 28 provided in the head 10. Other types of impact switches may optionally be used. The impact switch 66 and electrical circuit are normally open. The impact switch 66 closes upon impact between the head and the golf ball G at substantially any position on the face 76.

The second switch 68 is approximately horizontally, longitudinally aligned along line C—C with the center of gravity, COG, of the head 60, located within the cavity, and the approximate center of the face 76 of the head. The second switch 68 is a preferably a leaf switch illustrated in greater detail in FIG. 6. The leaf switch 68 includes a stationary center leaf 78 and adjacent moveable side leafs 80 and 82. Normally, the leaf switch is closed and contacts 84 and 86 at the free ends of the respective side leaves 80 and 82 electrically contact the center leaf 78.

Referring to FIG. 7, rotation of the club head 60 about the COG, as depicted by the arrows, D, due to impacts between the ball G and the face 76 at approximately off-center locations, causes one of the side leafs 80, 82 to break contact with the center leaf 78 and open the leaf switch 68. The particular side leaf which breaks contact depends on the location of the impact relative to the center of the face. Particularly, contacts approximately to the left of line C—C cause the side leaf 82 to open, and contacts approximately to the right of the line C—C cause the side leaf 80 to open.

Figure 5:
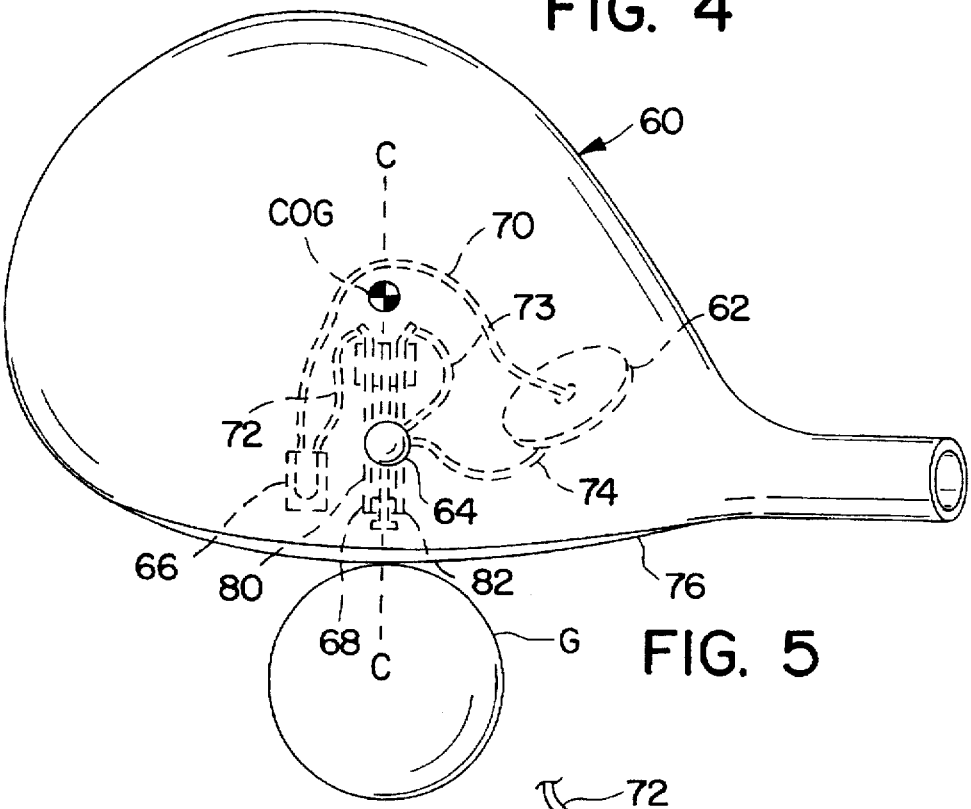
FIG. 5 is a top illustrational view, partially in broken line, of an illuminated golf club head in accordance with another embodiment of the invention, depicting the closed condition of the leaf switch upon impact of a golf ball at approximately the center of the club face.
Figure 6:
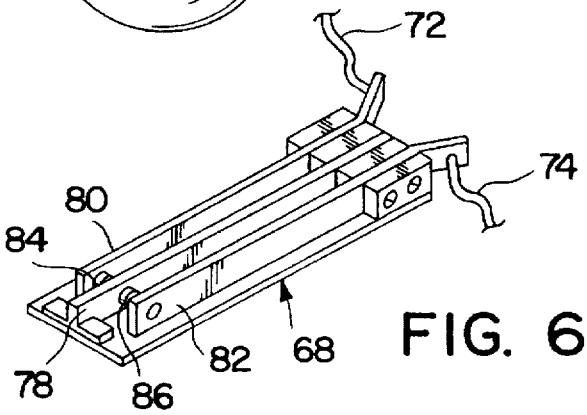
FIG. 6 is an enlarged perspective view of the leaf switch of the illuminated golf club head of FIG. 5.

Referring to FIG. 5, when impact is made at approximately the center of the face 76, approximately collinear with the line C—C and the COG of the club head 60, both side leafs 80, 82 of the leaf switch 68 remain closed, and the impact switch 66 closes the circuit, momentarily illuminating the LED 64. Thus, the LED is illuminated only when both of the switches 66, 68 are closed, which occurs only for impacts at approximately the center of the face 76.

Another preferred embodiment of the invention is illustrated in FIG. 9. The golf club head 90 is a putter having a neck 92 attached to a shaft 94. The club head 90 comprises an impact switch 96 including a movable leaf 98 and a weight 100 disposed on the free end of the movable leaf, a battery 110 electrically connected to the switch 96 via an electrical conductor 108, an LED 102 electrically connected to the switch 96 via an electrical conductor 106, and an electrical conductor 112 connecting the LED 102 and the battery 110. The LED is mounted at the top surface 116 of the club head 90. The switch 96 is preferably mounted to the inner surface of the outer wall 118 of the club head 90, and the switch, LED 102 and battery 110 are preferably secured in the interior cavity of the head with a lightweight foam material.

The impact switch 96 is more sensitive to impact than the switches in the club heads 10 and 60, as the impact force between the putter and the golf ball is less than for metal drivers. This increased sensitivity is provided by the weight 100 on the leaf 98. The impact switch 96 closes when the face 114 impacts with a golf ball during the forward stroke of a putt. Closing of the impact switch 96 completes the electrical circuit, momentarily illuminating the LED 102 and providing a signal visible to the golfer only if eye contact is maintained with the ball throughout the putt.

Therefore, the above-described golf club heads 10, 60 and 90 force golfers to focus on the ball during the entire swing.

After repetitively swinging a golf club with an attached head in accordance with the invention, golfers develop a "swing memory" and automatically assume the proper eye focus required to consistently strike the ball at the correct location on the golf head during different types of swings. Accordingly, the present invention has particular utility as a swing training aid.

Furthermore, the present invention has a simple construction and provides long-term reliable operation. Also, because the components of the lighting circuit are mounted within the club head, the illuminated golf club head is aesthetically attractive. The components are also small and lightweight, and minimally affect the balance of the club.

The foregoing description of the preferred embodiments of the invention have been presented to illustrate the principles of the invention and not to limit the invention to the particular embodiment illustrated. It is intended that the scope of the invention be defined by all of the embodiments encompassed within the following claims and their equivalents.

What is claimed is:

1. A golf club head for a golf club, comprising:

a) an outer wall including a top surface and a face and defining a cavity;

b) a light mounted to said outer wall;

c) a power source disposed within said cavity and electrically connected to said light; and d) switch means disposed within said cavity and electrically connected to said light and said power source to form an electrical circuit, wherein said switch means comprises a body mounted to an interior surface of said face, said body defining a chamber and comprising an end wall having an interior concave region, a pair of electrical conductors disposed in said chamber adjacent said end wall, a volume of mercury movable in said chamber, said volume of mercury naturally forming a droplet smaller than the distance between said pair of electrical conductors and in said natural form unable to simultaneously contact each of said electrical conductors regardless of the orientation of said switch, whereby upon an impact of said face of said golf club head with a golf ball, said volume of mercury collides against said concave region of said end wall and flattens sufficiently against said concave region of said end wall wherein said volume of mercury simultaneously contacts each of said electrical conductors and said switch means closes to complete said electrical circuit and momentarily illuminate said light.

2. The golf club head of claim 1, wherein said light comprises a light emitting diode (LED) mounted at said top surface of said outer wall.

3. The golf club head of claim 1, wherein said power source is a lithium battery.

4. The golf club head of claim 1, wherein the golf club head is a metal driver.

5. The golf club head of claim 1, wherein the golf club head is a putter.

6. The golf club head of claim 1, wherein said light is oriented so as to be in the direct line of sight of a golfer at the point of impact of said face of said golf club head with a golf ball during the forward stroke of a golf swing.

7. A golf club, comprising:

a) a shaft; and b) a golf club head attached to an end of said shaft, said golf club head comprising:

i) an outer wall including a top surface and a face and defining a cavity;

ii) a light mounted to said outer wall;

iii) a power source disposed within said cavity and electrically connected to said light; and iv) switch means disposed within said cavity and electrically connected to said light and said power source to form an electrical circuit, wherein said switch means comprises a body mounted to an interior surface of said face, said body defining a chamber and comprising an end wall having an interior concave region, a pair of electrical conductors disposed in said chamber adjacent said end wall, a volume of mercury movable in said chamber, said volume of mercury naturally forming a droplet smaller than the distance between said pair of electrical conductors and in said natural form unable to simultaneously contact each of said electrical conductors regardless of the orientation of said switch, whereby upon an impact of said face of said golf club head with a golf ball, said volume of mercury collides against said concave region of said end wall and flattens sufficiently against said concave region of said end wall wherein said volume of mercury simultaneously contacts each of said electrical conductors and said switch means closes to complete said electrical circuit and illuminate said light.

8. The golf club of claim 7, wherein said light comprises a light emitting diode (LED) mounted at said top surface of said outer wall.

9. The golf club of claim 8, wherein the golf club is a putter.

10. The golf club of claim 8, wherein said light is oriented so as to be in the direct line of sight of the golfer upon said impact of said face with a golf ball.

11. The golf club of claim 7, wherein the golf club is a metal driver.

12. A golf club head for a golf club, comprising:

a) an outer wall including a top surface and a face and defining a cavity;

b) a light mounted to said outer wall;

c) a power source disposed within said cavity and electrically connected to said light; and d) switch means disposed within said cavity and electrically connected to said light and said power source to form an electrical circuit, wherein said switch means comprises a first and second switch, said first switch normally in an open condition and adapted to close upon impact of a golf ball at substantially any location on said face, said first switch comprising a body mounted to an interior surface of said face, said body defining a chamber and comprising an end wall having an interior concave region, a pair of electrical conductors disposed in said chamber adjacent said end wall, a volume of mercury movable in said chamber, said volume of mercury naturally forming a droplet smaller than the distance between said pair of electrical conductors and in said natural form unable to simultaneously contact each of said electrical conductors regardless of the orientation of said first switch, said second switch normally in a closed condition and adapted to open upon impact of a golf ball at an approximately off-center location on said face, said second switch comprising a leaf switch, whereby upon an impact of said face of said golf club head with a golf ball at approximately the center of said face, said volume of mercury collides against said concave region of said end wall and flattens sufficiently against said concave region of said end wall wherein said volume of mercury simultaneously contacts each of said electrical conductors and said first switch closes and said second switch remains closed to complete said electrical circuit and momentarily illuminate said light.

13. The golf club head of claim 12 wherein said light comprises a light emitting diode (LED) mourned at said top surface of said outer wall and is oriented so as to be in the direct line of sight of a golfer at the point of impact of said face of said golf club head with a golf ball at approximately the center of said face during the forward stroke of a golf swing.

14. The golf club head of claim 12, wherein said power source is a lithium battery.

15. The golf club head according to claim 12, wherein said leaf switch comprises a stationary center leaf and an adjacent movable side leaf on either side of said center leaf, said side leaf having a fixed end and a free end, said free end of said side leaf having a contact thereon, said contact in electrical contact with said center leaf, whereby upon impact of a golf ball at approximately the center of said face said side leaf contact remains in contact with said center leaf and said leaf switch remains closed, and whereby upon impact of a golf ball at an approximately off-center location on said face at least one of said side leaf contact breaks contact with said center led and said leaf switch opens.

16. The golf club head according to claim 12, wherein said second switch is approximately horizontally, longitudinally aligned with the center of gravity of said golf club head and the center of said face of said golf club head.

17. A switch for use in a golf club head having a face for impacting a golf ball during a swing, said switch comprising:

a) a body defining a chamber and comprising an end wall having an interior concave region said end wall adaptable for mounting to an interior surface of said face of said golf club head;

b) a pair of electrical conductors disposed in said chamber adjacent said end wall; and c) a volume of mercury movable in said chamber, said volume of mercury naturally forming a droplet smaller than the distance between said pair of electrical conductors and in said natural form unable to simultaneously contact each of said electrical conductors regardless of the orientation of said switch, whereby upon impact of said face of said golf club head with a golf ball, said volume of mercury collides against said face concave region of said end wall and flattens sufficiently against said concave region of said end wall wherein said volume of mercury simultaneously contacts each of said electrical conductors to momentarily close said switch.

* * * * *

UNITED STATES PATENT AND TRADEMARK OFFICE

CERTIFICATE OF CORRECTION

PATENT NO. : 5,630,764

DATED : May 20, 1997

INVENTOR(S) : Rhett McNair

It is certified that error appears in the above-identified patent and that said Letters Patent is hereby corrected as shown below:

Column 1, line 12: "head Just prior" should read --head just prior--.

Column 7, line 6: "(LED) mourned at" should read --(LED) mounted at--.

Signed and Sealed this

Twenty-ninth Day of July, 1997

Bruce Lehman

*Attest:*

BRUCE LEHMAN

*Attesting Officer*

*Commissioner of Patents and Trademarks*